US008876035B2

(12) United States Patent
Yamaguchi

(10) Patent No.: US 8,876,035 B2
(45) Date of Patent: Nov. 4, 2014

(54) WINDING CORE FOR COIL WINDING DEVICE

(71) Applicant: Kabushiki Kaisha Toyota Jidoshokki, Kariya (JP)

(72) Inventor: Kazuyuki Yamaguchi, Aichi-ken (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 112 days.

(21) Appl. No.: 13/836,349

(22) Filed: Mar. 15, 2013

(65) Prior Publication Data

US 2013/0277493 A1 Oct. 24, 2013

(30) Foreign Application Priority Data

Apr. 19, 2012 (JP) ..... 2012-095967

(51) Int. Cl.

| | |
|---|---|
| ***B65H 75/24*** | (2006.01) |
| ***B65H 75/08*** | (2006.01) |
| ***B65H 75/18*** | (2006.01) |
| ***H01F 41/06*** | (2006.01) |

(52) U.S. Cl.

CPC ..... *B65H 75/18* (2013.01); *H01F 41/065* (2013.01); *H01F 41/0687* (2013.01); *B65H 75/242* (2013.01)

USPC ..... 242/573.2; 242/604; 242/613.2; 242/118.1

(58) Field of Classification Search

USPC ..... 242/600, 604, 613, 613.1, 613.2, 118, 242/118.1, 118.11, 571, 572, 573, 573.2

See application file for complete search history.

(56) References Cited

U.S. PATENT DOCUMENTS

| | | | | | |
|---|---|---|---|---|---|
| 355,145 | A | * | 12/1886 | Davis et al. | 242/609 |
| 2,425,155 | A | * | 8/1947 | Jarvis | 242/610.2 |
| 2,714,997 | A | * | 8/1955 | Weisbart | 242/118.32 |
| 2,916,226 | A | * | 12/1959 | McGraw, Jr. | 242/610.4 |
| 3,189,857 | A | * | 6/1965 | Jones | 336/198 |
| 3,363,210 | A | * | 1/1968 | Hollyday | 336/185 |
| 3,989,200 | A | * | 11/1976 | Bachi | 242/437.3 |
| 2013/0056110 | A1 | * | 3/2013 | Yamaguchi et al. | 140/71 |

FOREIGN PATENT DOCUMENTS

JP 2010-004589 A 1/2010

* cited by examiner

*Primary Examiner* — William E Dondero
(74) *Attorney, Agent, or Firm* — Sughrue Mion, PLLC

(57) ABSTRACT

A winding core for a coil winding device having a column shape with corners each having a rounded cross-section is used for forming a coil by winding a wire around the winding core into the coil of a polygonal shape. The winding core includes a helical continuous surface extending spirally around an axis of the winding core.

5 Claims, 9 Drawing Sheets

WINDING CORE FOR COIL WINDING DEVICE

BACKGROUND OF THE INVENTION

The present invention relates to a winding core for a coil winding device.

When a wire is bent into a generally square shape or any other polygonal shape in winding the wire around a winding core of a winder to form a coil, the wire is sprung back from the intended bending angle. In the coil winding device disclosed in Japanese Patent Application Publication No. 2010.4589, the winding core of the winder is formed helically with the springback taken into previous consideration. More specifically, the winding core includes four core bars each having a substantially rectangular cross-section with four rounded corners and the wire is wound around the winding core for N times (N is an integer of two or more) to form a coil. The winding core has winding tracks forming N steps for winding wire and the winding tracks are formed such that each four corners of the winding tracks are circumferentially deviated every step to make the winding core into a helical shape.

Referring to FIG. 9A showing the background art according to the above-cited Publication No. 2010-4589, the helical winding core 100 has winding tracks 101, 102, 103, 104 and a step is formed between any two adjacent winding tracks, as shown in FIG. 9A. Each of the winding tracks 101, 102, 103, 104 has a contacting surface with which the wire (flat wire) 110 is in perpendicular contact. The wire 110 is pressed against the winding core 100 by the guide member 120 of a pressing roller. The wire 110 pressed against the step by the guide member 120 is moved to the adjacent step formed between the winding tracks 101, 102, 103, 104, so that the wire 110 is damaged by the step. For preventing the above damage to the wire 110, the winding tracks 101, 102, 103, 104 may be widened or the width W of the winding tracks 101, 102, 103, 104 may be increased, as shown in FIG. 9B so that the wire 110 is not moved to the adjacent step. However, widening the tracks 101, 102, 103, 104 widens the clearance between any two adjacent turns of the wire in the axial direction of the winding core 100 and increases the total length of the coil.

The present invention is directed to providing a winding core for a coil winding device by which damage to a wire hardly occurs and an increase of the total length of wound coil is prevented.

SUMMARY OF THE INVENTION

In accordance with the present invention, a winding core for a coil winding device having a column shape with corners each having a rounded cross-section is used for forming a coil by winding a wire around the winding core into the coil of a polygonal shape. The winding core includes a helical continuous surface extending spirally around an axis of the winding core.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE PREFERRED EMBODIMENTS

Figure 1:
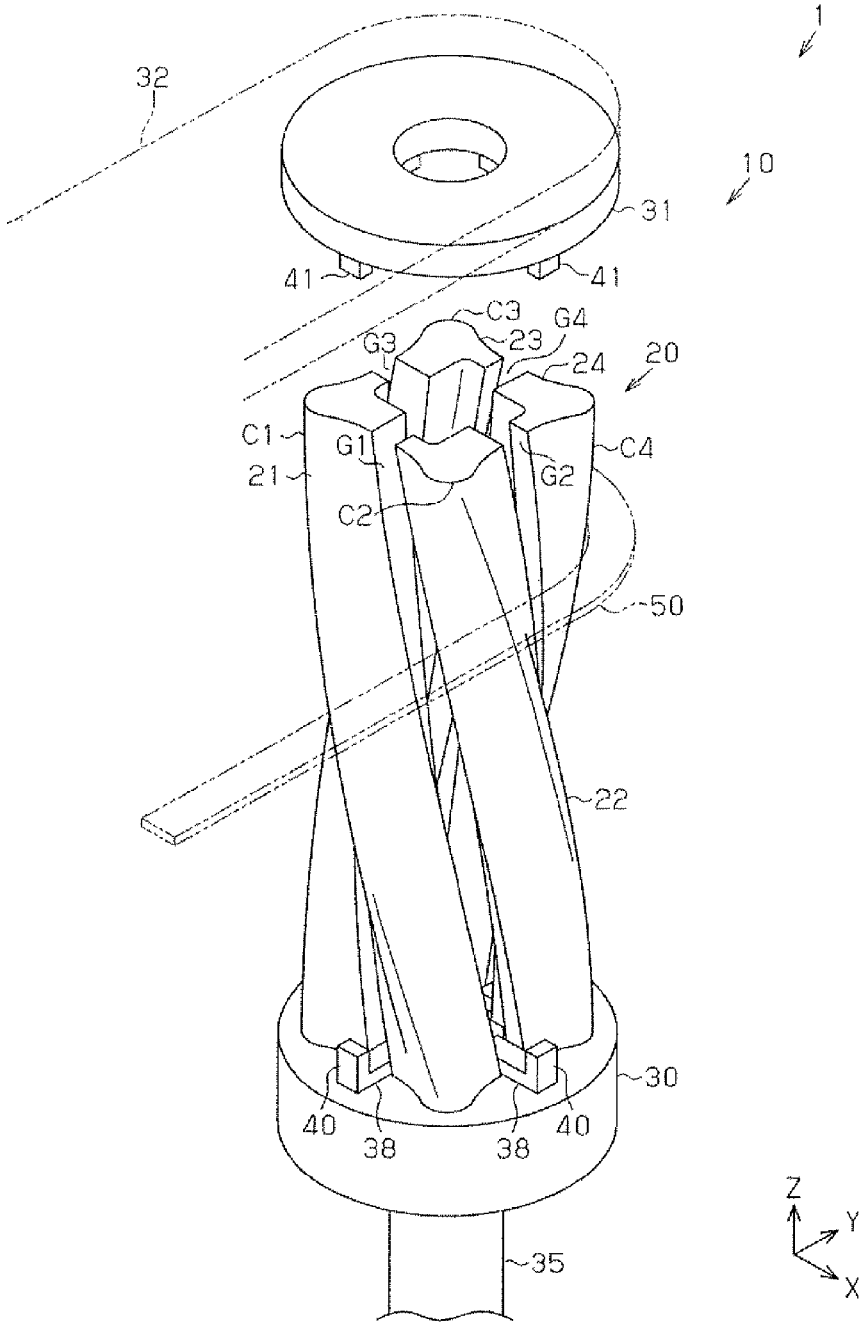
FIG. 1 is a schematic perspective view of a coil winding device having a winding core according to a first preferred embodiment of the present invention.

The following will describe a coil winding device according to a first preferred embodiment with reference to FIGS. 1 through 5. It is noted that the arrows X, Y and Z in the drawing show three different directions in the three-dimensional coordinate system of the coil winding device.

Referring to FIG. 1, reference numeral 1 designates a coil winding device. The coil winding device 1 includes a winder 10 having a winding core 20. The coil winding device 1 is used for forming a coil by winding a flat wire 50 around the columnar winding core 20 into a coil of a generally rectangular shape. The flat wire 50 has a rectangular cross-section and is wound edgeways to form the coil. The winding core 20 is rotatably supported.

Figure 2:
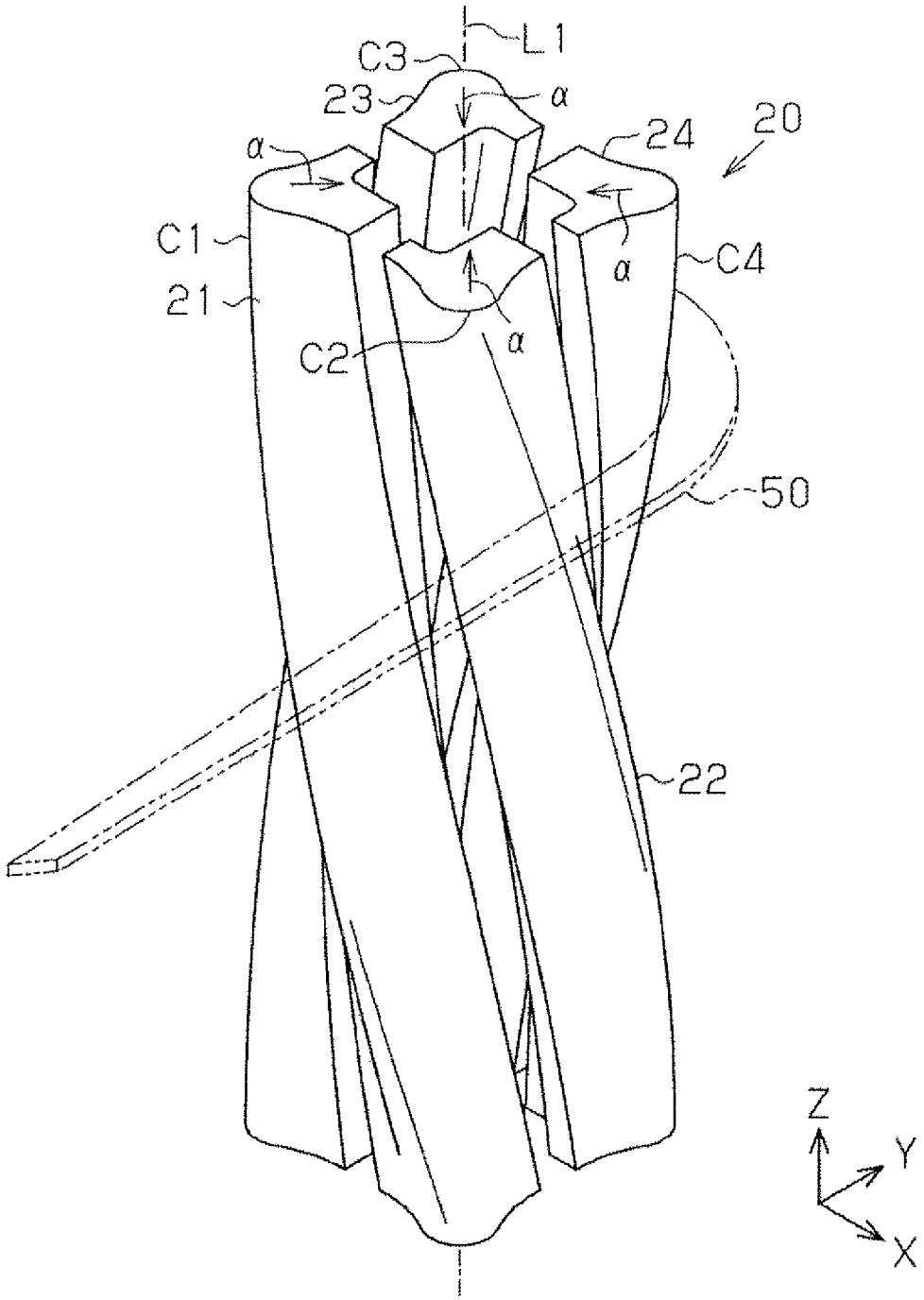
FIG. 2 is a perspective view of the winding core of FIG. 1.
Figure 3:
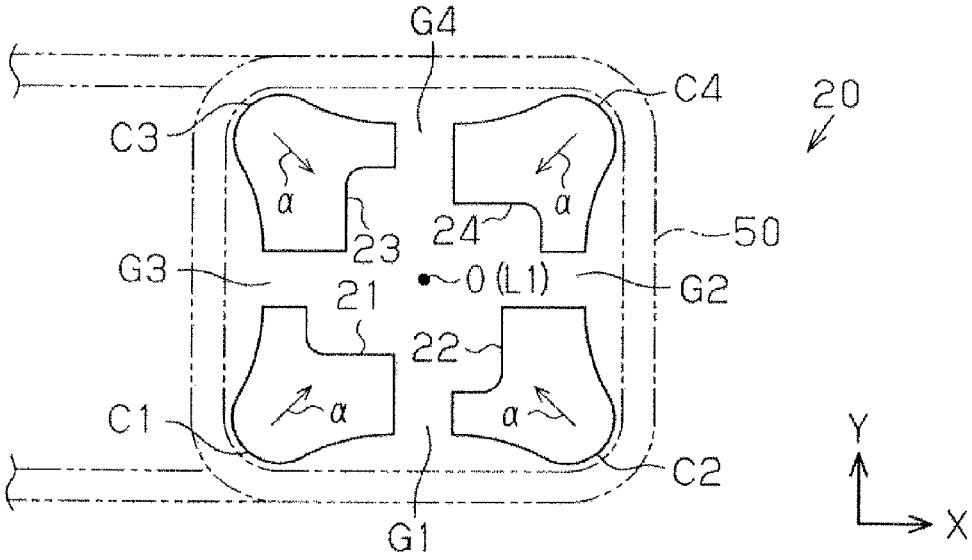
FIG. 3 is an end view of the winding core of FIG. 1.

Referring also to FIGS. 2, 3, the winding core 20 is divided into four core bars, namely a first core bar 21, a second core bar 22, a third core bar 23 and a fourth core bar 24.

The winding core 20 as a whole has a generally square column shape with four corners, namely first through fourth corners C1, C2, C3, C4 each of which is rounded. The first through fourth corners C1, C2, C3, C4 have a rounded cross-section. The first core bar 21 has the first corner C1. The second core bar 22 has the second corner C2. The third core bar 23 has the third corner C3. The fourth core bar 21 has the fourth corner C4. L1 in FIGS. 2 and 3 indicates the axis of the square columnar winding core 20.

The first through fourth core bars 21, 22, 23, 24 have a shape of a twisted rod and the first through fourth corners C1, C2, C3, C4 thereof have a helical continuous smooth surface extending spirally around the axis L1.

A first helical space G1 is formed between the first and the second core bars 21, 22, as shown in FIGS. 1 and 3. Similarly, a second helical space G2 is formed between the second and the fourth core bar 22, 24, a third helical space G3 is formed between the first and the third core bar 21, 23 and a fourth helical space G4 is formed between the third and the fourth core bars 23, 24, as shown in FIGS. 1 and 3.

As shown in FIG. 3, the first through fourth core bars 21, 22, 23, 24 are slidably supported by means of a slide mechanism such that the first through fourth core bars 21, 22, 23, 24 can be moved toward and away from the center O of the winding core 20. The arrows α in FIGS. 2 and 3 show the directions in which the respective first through fourth core bars 21, 22, 23,24 are moved toward the center O. After the winding of the flat wire 50 is completed, the first through fourth core bars 21, 22, 23, 24 slide inward or in the direction α, so that the contacting surfaces of the first through fourth core bars 21, 22, 23, 24 with the flat wire 50 at the rounded first through fourth corners C1, C2, C3, C4 are moved inward and separated away from the flat wire 50.

The coil winding device 1 further includes a lower plate (bottom block) 30 and an upper plate (top block) 31. As shown in FIG. 1, the first through fourth core bars 21, 22, 23, 24 are disposed upright on the lower plate 30. The upper plate 31 is provided on the top of the first through fourth core bars 21, 22, 23, 24. In other words, the first through fourth core bars 21, 22, 23, 24 are supported and held between the lower plate 30 and the upper plate 31 in an upright position.

Figure 4:
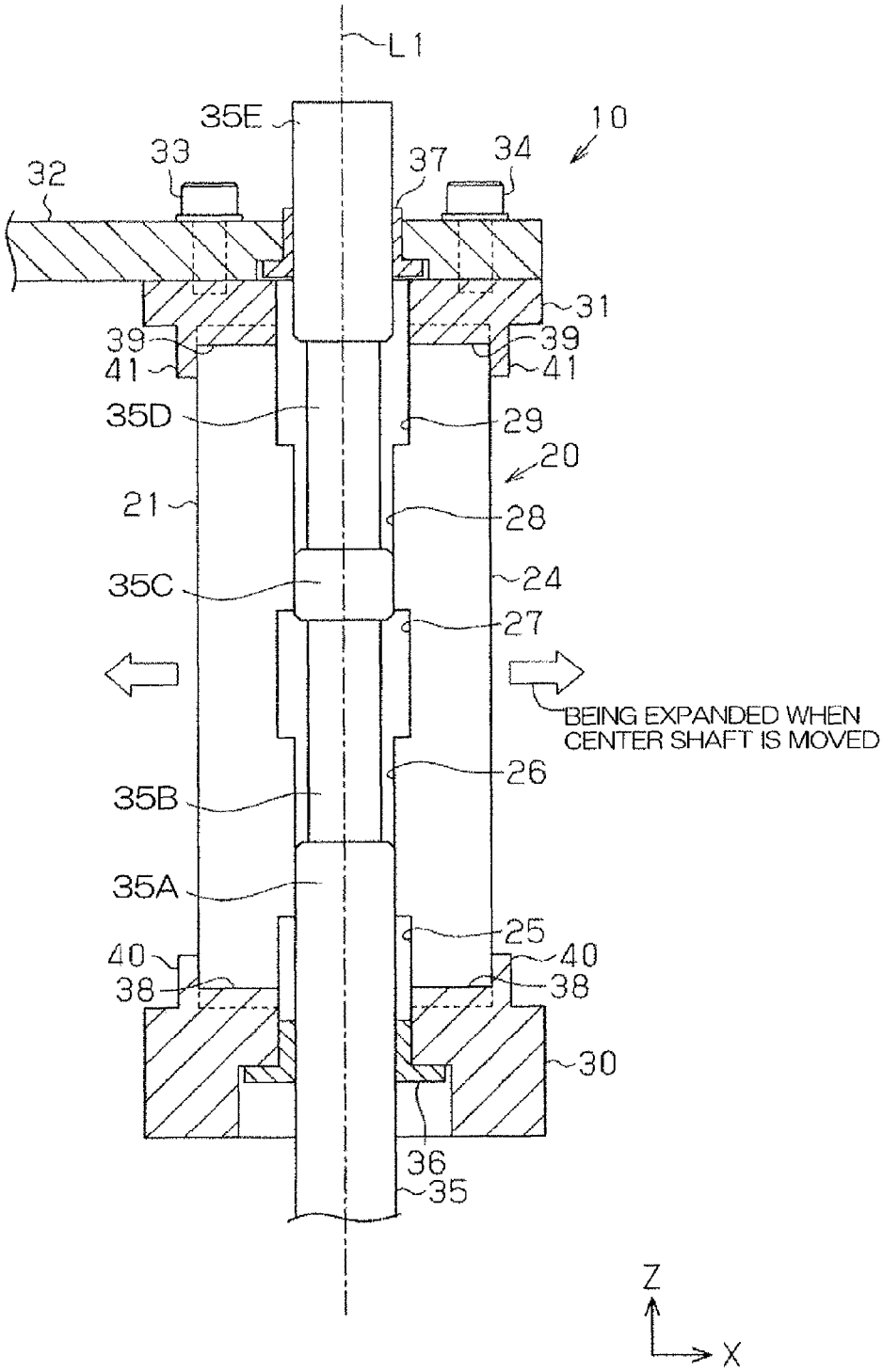
FIG. 4 is a longitudinal sectional schematic view of the winding core of FIG. 1, showing the expanded state of the winding core.

Referring to FIG. 4, an arm 32 is disposed above the upper plate 31 and extends horizontally. The arm 32 is fastened at the proximal end thereof to the upper plate 31 by bolts 33, 34. A center shaft 35 extends through the center part of the lower plate 30. The center shaft 35 is supported at the lower part thereof by a bearing 36 so as to be movable up and down. The center shaft 35 extends also through the center of the upper plate 31 and is supported at the upper part thereof by a bearing 37 so as to be movable up and down.

The lower plate 30 has on the top surface thereof a plurality of guide members 38. Similarly, the upper plate 31 has on the bottom surface thereof a plurality of guide members 39. The first through fourth core bars 21, 22, 23, 24 are slidable in radial direction toward and away from the center O of the winding core 20 while being guided by the guide members 38, 39.

The lower plate 30 has a stop projection 40 on the top surface thereof and the upper plate 31 has a stop projection 41 on the bottom surface thereof. The center shaft 35 extends through the center of the winding core 20.

The center shaft 35 has three large-diameter portions 35A, 35C, 35E and two small-diameter portions 35B, 35D. The large-diameter portion 35A, the small-diameter portion 35B, the large-diameter portion 35C, the small-diameter portion 35D and the large-diameter portion 35E are positioned in this order from the bottom to the top of the center shaft 35.

Figure 5:
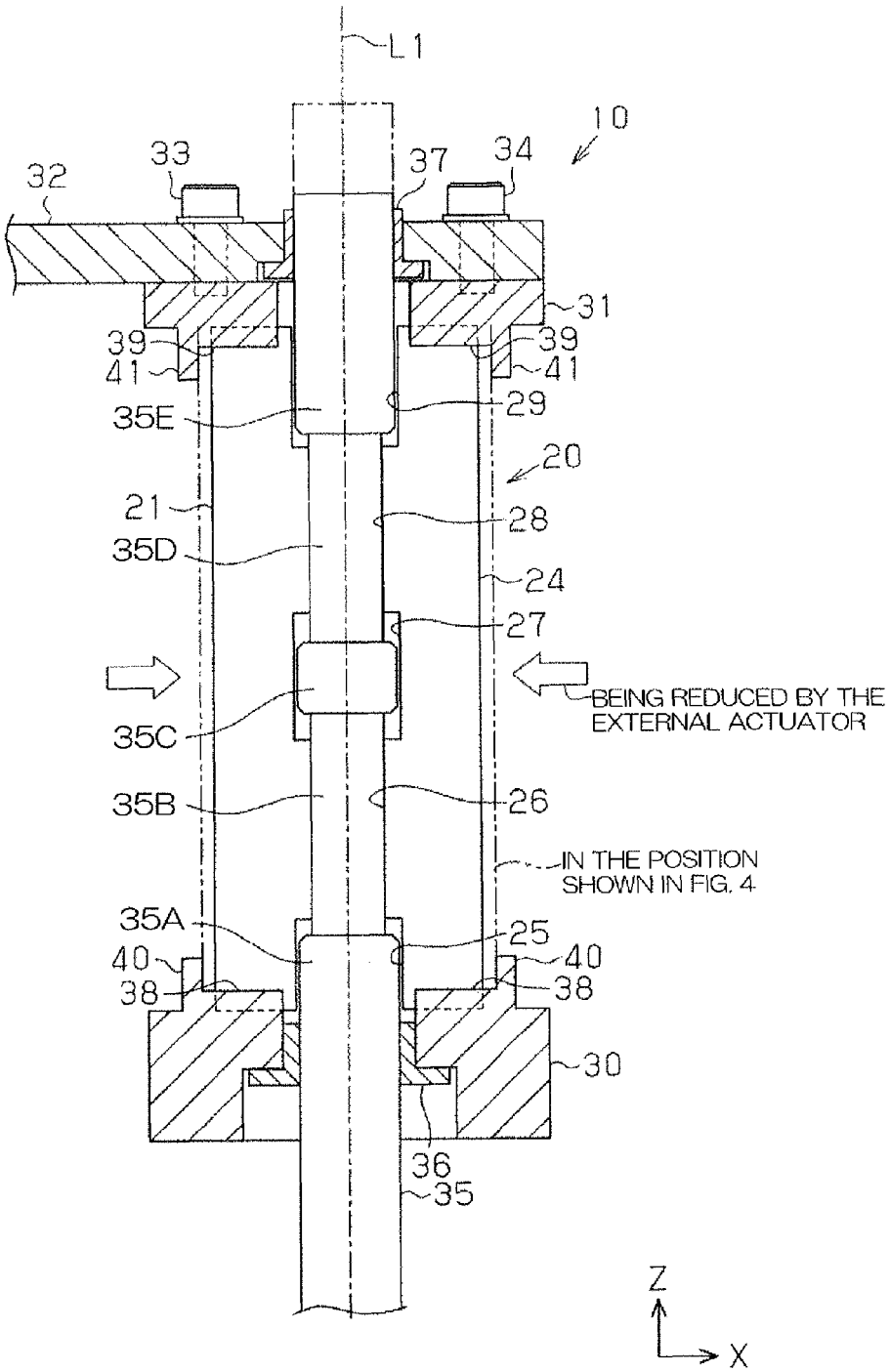
FIG. 5 is a longitudinal sectional schematic view of the winding core of FIG. 1, showing the contracted state of the winding core.

The first through fourth core bars 21, 22, 23, 24 (winding core 20) have on the inner peripheral surfaces thereof large-diameter portions 25, 27, 29 and small-diameter portions 26, 28. The large-diameter portion 25, the small-diameter portion 26, the large-diameter portion 27, the small-diameter portion 28 and the large-diameter portion 29 are positioned in this order as seen from the bottom to the top of the winding core 20. As shown in FIG. 5, the winding core 20 is pushed inward by an external actuator (not shown) such that the inner peripheral surfaces of the first through fourth core bars 21, 22, 23, 24 are brought into contact with the outer peripheral surface of the center shaft 35. Thus, the first through fourth core bars 21, 22, 23, 24 are moved inward or toward the center O, so that the diameter of the winding core 20 is reduced.

The center shaft 35 is movable up and down. When the small-diameter portions 26, 28 of the first through fourth core bars 21, 22, 23, 24 and the small-diameter portions 35B, 35D of the center shaft 35 are in contact with each other, the first through fourth core bars 21, 22, 23, 24 are located in the contracted position, as shown in FIG. 5. When the small-diameter portions 26, 28 of the first through fourth core bars 21, 22, 23, 24 and the large-diameter portions 35A, 35C of the center shaft 35 are in contact with each other, the first through fourth core bars 21, 22, 23, 24 are located in the expanded position, as shown in FIG. 4. At this time, the first through fourth core bars 21, 22, 23, 24 are placed in contact with the stop projections 40, 41 formed on the lower and the upper plates 30, 31, respectively.

When the center shaft 35 is moved upward, the first through fourth core bars 21, 22, 23, 24 of the winding core 20 are separated by being pushed away from each other in radial direction by steps of the center shaft 35. Thus, the coil winding device 1 is placed in the expanded position shown in FIG. 4. When the center shaft 35 is moved downward, on the other hand, the large-diameter portions 35A, 35C, 35E of the center shaft 35 are located in the large-diameter portions 25, 27, 29 of the first through fourth core bars 21, 22, 23, 24 with clearances formed between the large-diameter portions 35A, 35C, 35E and the large-diameter portions 25, 27, 29, respectively. Then, the clearances are reduced by the external actuator. Thus, the coil winding device 1 is placed in the contracted position as shown in FIG. 5.

Winding of the wire is performed around the winding core 20 in the expanded position shown in FIG. 4 and, after completion of the winding of wire, the wound wire (coil) is removed from the winding core 20 which is contracted as shown in FIG. 5. The flat wire 50 is wound while being guided along the winding core 20 by a guide member (not shown). In the winding, the flat wire 50 is pressed at the short side of the rectangular cross-section of the flat wire 50 against the winding surface (or contact surface) of the winding core 20. In the winding of the flat wire 50, the relative positions of the flat wire 50 and the winding core 20 in the vertical direction is changed. Specifically, the winding of the flat wire 50 is performed while the winding core 20 is being moved downward with the flat wire 50 kept at a predetermined height.

The following will describe the operation of the coil winding device 1 (winding core 20) constructed as described above. With the center shaft 35 placed in the raised position as shown in FIG. 4, the small-diameter portions 26, 28 of the first through fourth core bars 21, 22, 23, 24 and the large-diameter portions 35A, 35C of the center shaft 35 are in contact with each other, so that the first through the fourth core bars 21, 22, 23, 24 are located away from each other.

In this state of the winding core 20, one end of the flat wire 50 is fixed to the winding core 20 of the winder 10. The flat wire 50 is pressed against the peripheral surface of the winding core 20 and wound edgeways around the winding core 20 by rotating the winding core 20, thereby forming a coil.

As shown in FIGS. 1 and 2, the first through fourth corners C1, C2, C3, C4 corresponding to the outer peripheral surfaces (side surfaces) of the winding core 20 around which the flat wire 50 is wound are formed helically around the axis L1.

The winding core 20 has a helical shape which is formed with the springback of the wound flat wire 50 taken into consideration preciously, so that the flat wire 50 removed from the winding core 20 and sprung back takes an intended shape having no distortion.

After the winding of the flat wire 50 is completed, the center shaft 35 is moved downward and the small-diameter portions 26, 28 of the first through fourth core bars 21, 22, 23, 24 and the small-diameter portions 35B, 35D are in contact with each other, so that the first through the fourth core bars 21, 22, 23, 24 are moved to the contracted position of FIG. 5. That is, after winding of the flat wire 50, the first through the fourth core bars 21, 22, 23, 24 are moved inwardly or toward the axis L1, so that the wound flat wire 50 may be removed from the winding core 20.

Figure 9A:
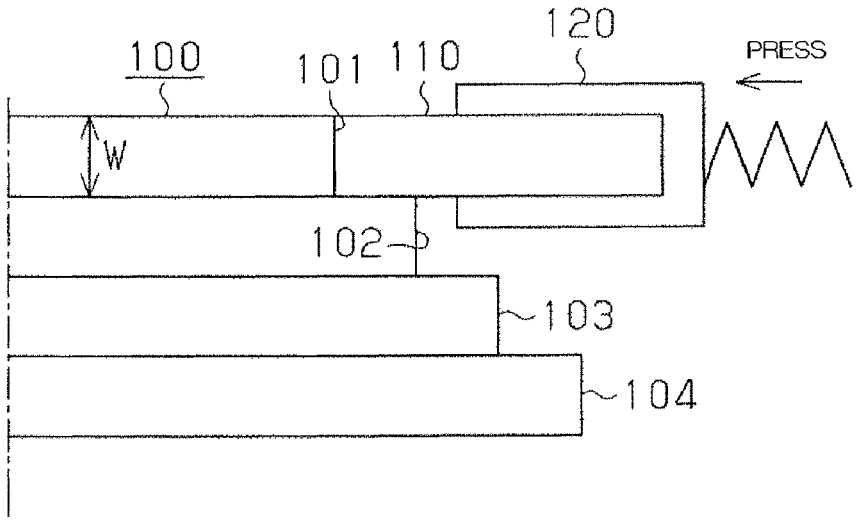
FIG. 9A is a schematic front view showing a winding core of the coil winding device according to the background art of the present invention.
Figure 9B:
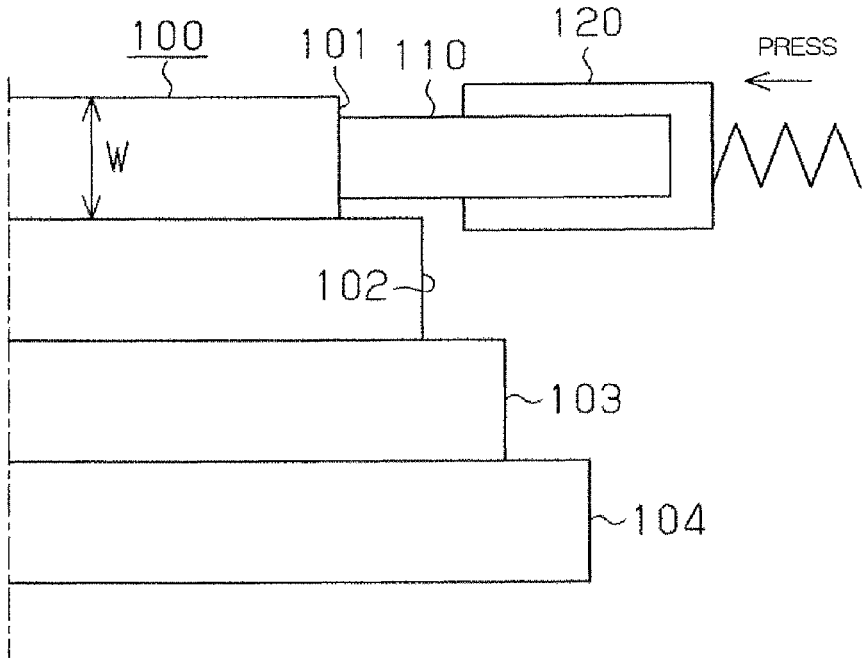
FIG. 9B is a schematic front view showing a modified over the winding core of FIG. 9A.

The winding angle of the winding core 20 is corrected by twisting the winding core 20 around the rotation center (center axis) of the winding core 20 by an amount of the springback of the winding core 20. The first through fourth corners C1, C2, C3, C4 have a helical continuous smooth surface extending spirally around the axis L1, so that the wire is hardly susceptible to a damage by the steps as described with reference to FIG. 9A and an increase of the total length of the completed coil shown in FIG. 9B is prevented. Since the first through fourth corners C1, C2, C3, C4 of the winding core 20 have a helical continuous smooth surface such that the completed coil formed by bending slips thereon in the axial direction thereof, damage to the coil by the steps hardly occurs and an increase of the total length of the completed coil and twisting caused by springback are prevented.

The formed coil caught on the winding core 20 due to springback is pulled out easily from the winding core 20 by contracting the winding core 20. After pulling out the coil from the winding core 20, the winding core 20 is expanded so as to move the first through fourth core bars 21, 22, 23, 24 back in the expanded position.

The following advantageous effects are obtained in the embodiment.

(1) In the coil winding device 1, the winding core 20 has a column shape having the rounded first through fourth corners C1, C2, C3, C4 each having a rounded cross-section. The first through fourth corners C1, C2, C3, C4 have a helical continuous smooth surface extending spirally around the axis L1 of the winding core 20. Thus, the wire (flat wire 50) is prevented from damage by the steps as described earlier with reference to FIGS. 9A and 9B. Since damage of the wire by the steps need not to be considered, the clearance between any two adjacent turns of wire in the axial direction of the winding core 20 is reduced and an increase of the total length of the wound coil is prevented. Therefore, damage to the wire is hardly occurred and an increase of the total length of the wound coil is prevented.

(2) The winding core 20 which is divided into a plurality of the first through fourth core bars 21, 22, 23, 24 movable inwardly away from the wound flat wire 50 allows the wound wire (coil) to be removed easily from the winding core 20.

(3) The winding core 20 according to the embodiment which is divided into four core bars 21, 22, 23, 24 having the rounded first through fourth corners C1, C2, C3, C4 facilitate removal of wound wire (coil) from the winding core 20 by replacement of the rounded first through fourth corners C1, C2, C3, C4.

(4) The first through fourth helical spaces G1, G2, G3, G4 formed between the first through fourth core bars 21, 22, 23, 24 extend in a helical manner. Thus, the first through fourth corners C1, C2, C3, C4 are formed in a helical shape, so that the coil is easily pulled out from the winding core 20.

The above embodiment may be modified in various ways as exemplified below.

Figure 6:
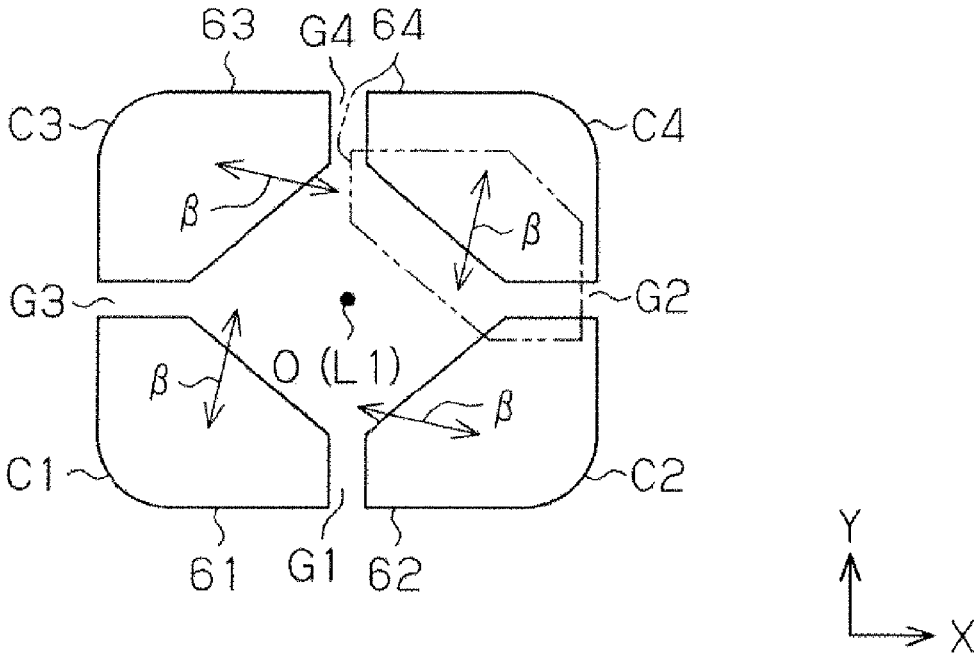
FIG. 6 is an end view of a coil winding device having a winding core according to another embodiment of the present invention.

In the structure for contracting the winding core 20, the path of movement of the first through fourth core bars 21, 22, 23, 24 is not limited to the movement in radial direction from the center of the winding core 20. The first through fourth core bars 21, 22, 23,24 may be moved in any way other than radially as long as they are moved inwardly. For example, the first through fourth core bars 61, 62, 63, 64 may be movable in the directions that are indicated by the double-headed arrows β in FIG. 6. Specifically, the double-headed arrows β in FIG. 6 is directed obliquely with respect to an imaginary line extending radially through the center O of the winding core 20.

In other words, the winding core 20 may be configured so that the first through fourth core bars 61, 62, 63, 64 are movable inwardly so as to allow the coil to be disengaged from the winding core 20 and to be removed therefrom.

The provision of the helically extending first through fourth helical spaces G1, G2, G3, G4 allows the first through fourth core bars 61, 62, 63, 64 to be moved in the β directions other than the direction toward away from the center O (or radial direction).

Figure 7:
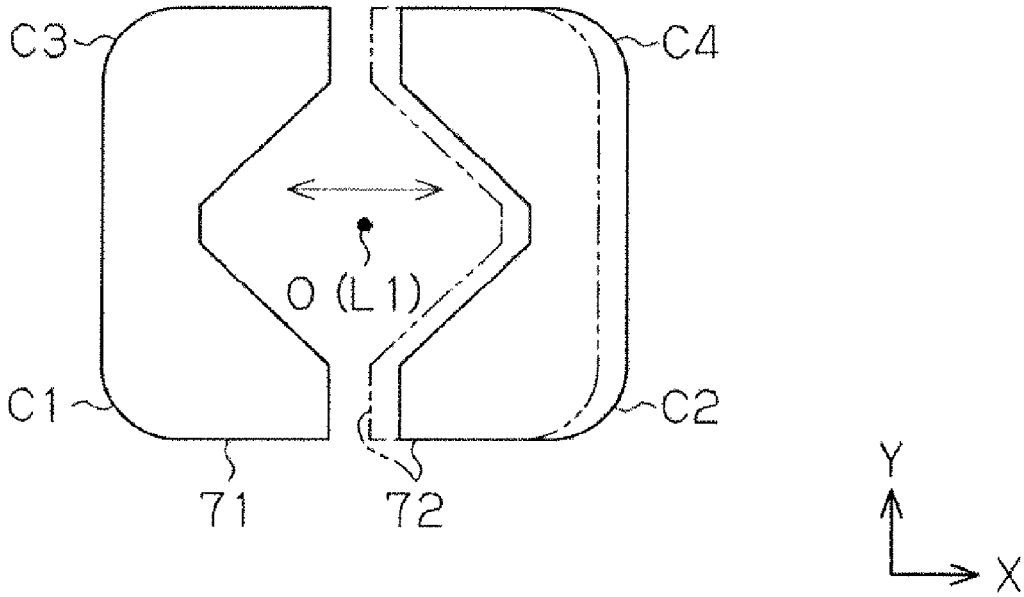
FIG. 7 is an end view of a coil winding device having a winding core according to yet another embodiment of the present invention.

According to the above embodiment, the winding core 20 is divided into four core bars. Furthermore, the winding core includes more than two core bars. FIG. 7 shows an embodiment wherein the winding core 20 includes two first and second core bars 71, 72.

Figure 8:
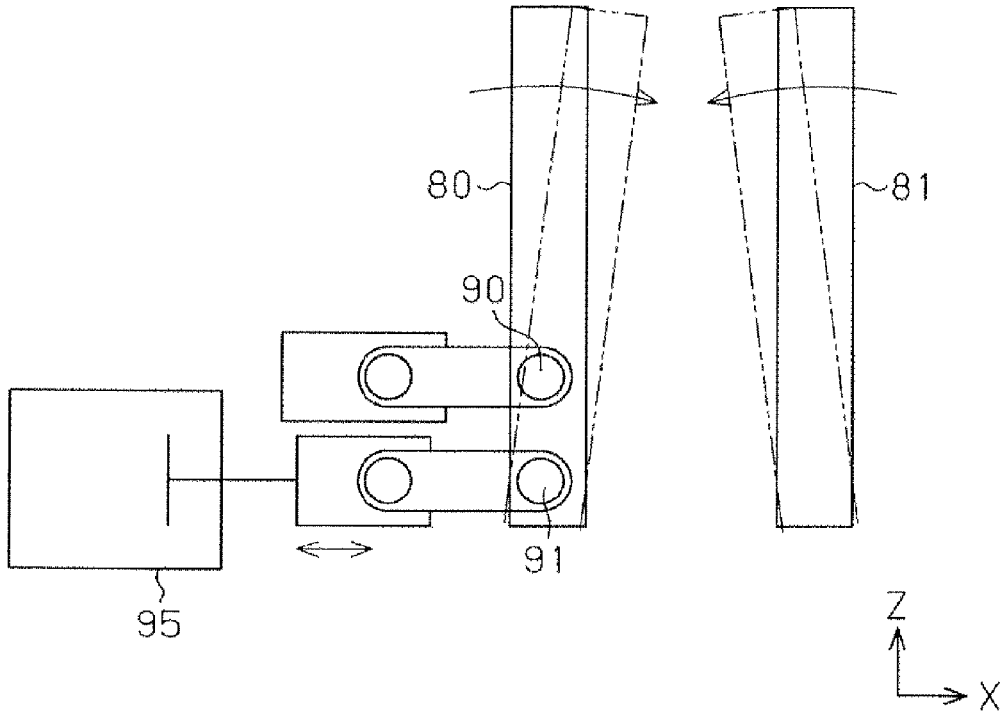
FIG. 8 is a schematic front view of a winding core according to still yet another embodiment of the present invention.

The structure for expanding and contracting the winding core 20 is not limited to the slide mechanism, but may be link mechanism or cam mechanism. Any structure that allows a coil to be removed from the winding core 20 is acceptable. FIG. 8 shows an example of the link mechanism, wherein first and second core bars 80, 81 are pivotally supported at a position adjacent to the bottom thereof by a pin 90 and the first and the second core bars 80, 81 are pivoted as indicated by arrows by a cylinder 95 that is operative connected to the bottom of the first and the second core bars 80, 81 through a pin 91.

The wire to be wound is not limited to a flat wire, but may be any other wire, such as a wire having a circular cross-section. The winding core 20 or the coil is not limited to have a rectangular shape, but may have any other shape, such as a rhombus shape or any other polygonal shape.

The winding core need not be formed by a plurality of core bars, but may be formed by a single core bar.

What is claimed is:

1. A winding core for a coil winding device, the winding core having a column shape with corners each having a rounded cross-section, the winding core used for forming a coil by winding a wire around the winding core into the coil of a polygonal shape, the winding core comprising:

the corners each having a helical continuous surface extending spirally around an axis of the winding core.

2. The winding core according to claim 1, wherein the winding core is divided into a plurality of core bars, and contacting surfaces of the core bars with the wires at the corners of the winding core are moved inward and separated away from the wire after the winding of the wire is completed.

3. The winding core according to claim 2, wherein the winding core includes two core bars.

4. The winding core according to claim 2, wherein the winding core includes four core bars.

5. The winding core according to claim 2, wherein each of spaces formed between the core bars extends in a helical manner.

* * * * *